United States Patent [19]

Meagher et al.

[11] 3,970,381

[45] July 20, 1976

[54] METHOD AND APPARATUS FOR XEROGRAPHIC REPRODUCTION

[75] Inventors: Thomas Meagher, West Webster; Robert J. Michatek, Fairport, both of N.Y.

[73] Assignee: Xerox Corporation, Stamford, Conn.

[22] Filed: Jan. 21, 1974

[21] Appl. No.: 435,349

Related U.S. Application Data

[63] Continuation of Ser. No. 335,967, Feb. 26, 1973, abandoned.

[52] U.S. Cl. ..... 355/3 R; 96/1 C; 271/DIG. 2; 271/193; 156/344

[51] Int. Cl.[2] ..... G03G 15/00; G03G 13/00

[58] Field of Search ..... 355/3 R, 14, 15, 17; 317/2 F, 262 A, 262 E; 271/DIG. 2, 18.1, 18.2, 174, 193; 96/1 C

[56] References Cited

UNITED STATES PATENTS

| | | | |
|---|---|---|---|
| 2,879,395 | 3/1959 | Walkup | 317/262 A X |
| 2,901,374 | 8/1959 | Gundlach | 355/17 X |
| 3,084,061 | 4/1963 | Hall | 355/17 X |
| 3,147,679 | 9/1964 | Schaffert | 355/17 X |
| 3,506,259 | 4/1970 | Caldwell et al. | 355/3 R X |
| 3,563,734 | 2/1971 | Shely | 355/17 X |
| 3,575,502 | 4/1971 | Eppe | 355/3 R |
| 3,620,615 | 11/1971 | Volkers | 355/3 R |
| 3,760,229 | 9/1973 | Silverberg | 317/2 F |

*Primary Examiner*—Fred L. Braun
*Attorney, Agent, or Firm*—B. A. Chiama; Earl T. Reichert

[57] ABSTRACT

Improved stripping of a transfer member (having a developed image thereon) from a photoconductive surface of an electrostatic reproduction machine is effected by charging the lead edge of the member with a first charge, and then charging the body of the member having the developed image thereon with a second charge which is different than the first charge. The second charge has a magnitude and polarity which prevents retransfer of the developed image to the photoconductive surface.

9 Claims, 3 Drawing Figures

METHOD AND APPARATUS FOR XEROGRAPHIC REPRODUCTION

This is a continuation of U.S. Application Ser. No. 335,967, filed Feb. 26, 1973 and now abandoned.

BACKGROUND OF THE INVENTION

In conventional xerography, a xerographic surface comprising a layer of photoconductive insulating material affixed to a conductive backing is used to support latent electrostatic images. In the process, the xerographic surface is electrostatically charged and the charged surface is then exposed to a light pattern of the image being reproduced to thereby discharge the surface in the areas where light strikes the surface. The undischarged areas of the surface thus form an electrostatic charge pattern conforming to the original pattern.

The latent electrostatic image is then developed by contacting it with a finely divided electrostatically attractable powder referred to hereinafter as "toner". The toner is held on the image areas by the electrostatic charge on the layer. Where the charge is greater, the greater amount of toner is deposited. Thus, a toner image is produced in conformity with a light image of the copy being reproduced. The developed image is then generally transferred to a suitable transfer member and the image affixed thereto to form a permanent record of the original document.

In the practice of xerography, the transfer member, ordinarily copy paper, is caused to move in synchronized contact with the photoconductive surface. During this time, an electrical potential opposite from the polarity on the toner is applied to the side of the paper remote from the photoconductive surface to electrostatically attract the toner image from the xerographic surface to the copy paper.

The copy paper, which is an insulator, retains the charge, while inducing a reverse charge in the nondischarged areas of the xerographic surface. This charge orientation creates an electrostatic bond between the paper and xerographic surface. Removal of the copy sheet and the toner image loosely adhering thereto has long been a problem in the xerographic art.

Numerous devices have been employed with varying degrees of success to remove copy sheets from the photoconductive surface in automatic xerographic reproduction apparatus. Probably one of the best known and most widely used devices is an air puffer. The copy sheet is stripped from the surface by introducing a relatively high pressure stream of air between the copy sheet and the surface to overcome the attraction between the paper and the surface.

However, when high air pressures are employed, the air tends to agitate the unfused toner image on the paper and disrupt the image configuration of the toner on the copy sheet. This exhibits itself as smears on the final copy. This blowing of toner powder may also result in toner dust problems in that the air stream broadcasts loose toner particles throughout the reproduction apparatus. Further, because of the volume and velocity of the air stream required to perform the stripping operation, puffer devices are inherently noisy and therefore undesirable.

Another technique for separating copy sheets from a xerographic surface is to mechanically wedge the copy sheet from the xerographic surface by means of mechanical picker fingers. However, since the fingers must of necessity be wedged between the photoconductive surface and the paper adhering thereto, the fingers have a tendency to scratch and abrade the xerographic surface.

Another method for removing copy sheets from the xerographic surface is to provide a vacuum stripping device for pulling the leading edge of the copy sheet from the xerographic surface for subsequent movement of the copy sheet away from the xerographic surface by a suitable paper transport. Problems may be encountered with this type of device in that the amount of vacuum required to strip the paper may be extremely high and the noise created by the air flow may be excessive. Further, the required spacing between the xerographic surface, the vacuum pickoff device, and the subsequent transport all give rise to areas wherein the paper may be jammed or deflected out of the desired paper path.

To minimize the air pressure or vacuum required for stripping the paper by "puffing" or vacuum, a corona discharge device may be utilized to reduce the electrostatic charge on the paper after transfer. In reducing the electrostatic attraction between the paper and the xerographic surface, the attraction between the paper and the toner is also reduced which may result in incomplete transfer of toner from the xerographic surface to the copy paper.

SUMMARY OF THE INVENTION

The present invention relates to a xerographic reproduction machine employing an AC corona discharge device for reducing the electrostatic attraction between the copy paper and the xerographic surface, the discharge device being biased by a first DC voltage of opposite polarity from the charge holding the copy sheet on the xerographic surface for influencing the leading edge of the copy sheet and a second DC voltage to provide a desired charge level on the copy paper of the same polarity as the charge on the xerographic surface for influencing the remainder of the copy sheet.

DESCRIPTION OF THE PREFERRED EMBODIMENT

Figure 1:
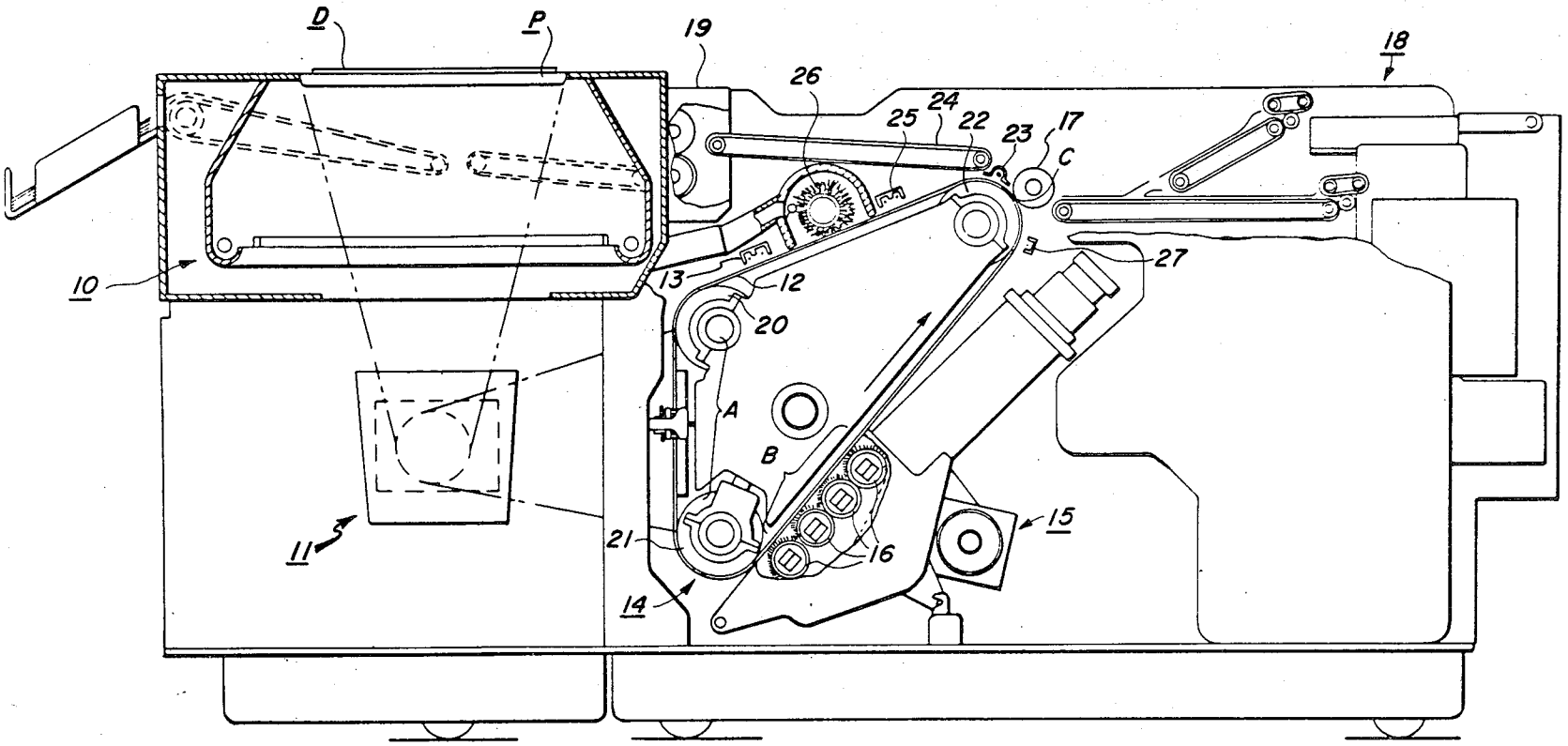
FIG. 1 is a schematic sectional view of an electrostatic reproduction machine embodying the principles of the present invention.

For a general understanding of an electrostatic processing system in which the invention may be incorporated, reference may be had to FIG. 1. As in all electrostatic systems such as a xerographic machine of the type illustrated, a light image of an original to be reproduced is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image corresponding to the latent image on the plate surface. The powder image is then electrostatically transferred to a support surface to which it may be fixed by a fusing device whereby the toner image is caused permanently to adhere to the support surface.

In the illustrated machine, an original D to be copied is placed upon a transparent support platen P fixedly arranged in an illumination assembly generally indicated by the reference numeral 10. While upon the platen, an illumination system flashes light rays upon the original, thereby producing image rays corresponding to the informational areas on the original. The image rays are projected by means of an optical system 11 to an exposure station A for exposing the photosensitive surface of a moving xerographic plate in the form of a flexible photoconductive belt 12. In moving in the direction indicated by the arrow, prior to reaching the exposure station A, that portion of the belt being exposed would have been uniformly charged by a corona device 13 located at a belt run extending between belt supporting rollers 20 and 22. The exposure station extends between the roller 20 and a third support roller 21.

The exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes around the roller 21 and through the developing station B located at a third run of the belt and in which there is positioned a developing apparatus generally indicated by the reference numeral 15. The developing apparatus 15 comprises a plurality of brushes 16 which carry developing material to the adjacent surface of the upwardly moving inclined photoconductive belt 12. As the developing material is applied to the xerographic belt, toner particles in the development material are attracted electrostatically to the belt surface to form powder images.

The developed electrostatic image is transported by the belt 12 to a transfer station C located at a point of tangency on the belt as it moves around the roller 22 whereat a sheet of copy paper is moved at a speed in synchronism with the moving belt in order to accomplish transfer of the developed image. There is provided at this station a transfer roller 17 which is arranged on the frame of the machine for contacting the non-transfer side of each sheet of copy paper as the same is brought into transfer engagement with the belt 12. The roller 17 is electrically biased with sufficient voltage so that a developed image on the belt may be electrostatically transferred to the adjacent side of a sheet of paper as the same is brought into contact therewith.

There is also provided a suitable sheet transport mechanism adapted to transport sheets of paper seriatim from a paper handling mechanism generally indicated by the reference numeral 18 to the developed image on the belt as the same is carried around the roller 22. A programming device operatively connected to the mechanism 18 and the illumination device for producing an electrostatic latent image on the belt 12 is effective to present a developed image at the transfer station C in timed sequence with the arrival of a sheet of paper.

As the sheet emerges from the transfer roller, it is influenced by a detacking corona discharge device 23 in a manner to be hereinafter explained. The sheet is thereafter retained on the underside of a transport mechanism 24 by suitable means such as vacuum for movement into a fuser assembly generally indicated by the reference numeral 19 wherein the developed and transferred xerographic powder image on the sheet is permanently affixed thereto. After fusing, the finished copy is discharged from the apparatus at a suitable point for the collection externally of the apparatus. The toner particles remaining as residue on the developed image, background particles, and those particles otherwise not transferred are carried by the belt 12 to a cleaning apparatus positioned on the run of the belt between the rollers 20, 22 adjacent the charging device 13. The cleaning device comprises a rotating brush 26 and a corona discharge device 25, for neutralizing charges remaining on the particles.

Figure 2:
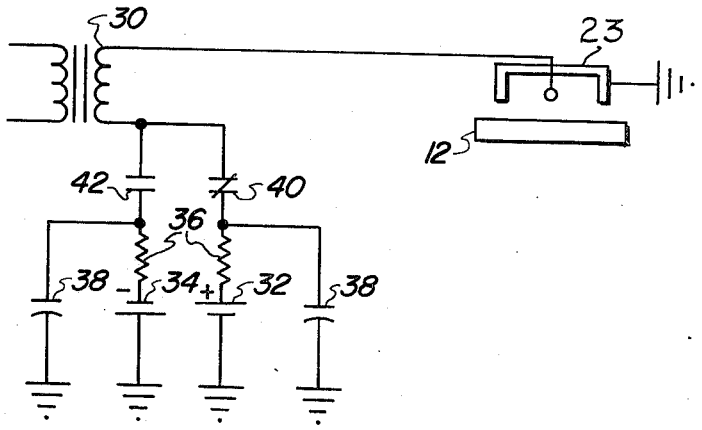
FIG. 2 is a schematic diagram of an electrical circuit for energizing a corona emission for improved stripping of copy sheets from a xerographic surface.
Figure 3:
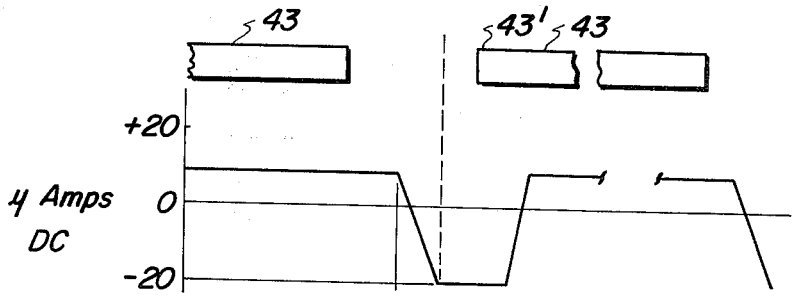
FIG. 3 is a plot of DC voltage supplied to the corona discharge device in relation to the leading edge and the body of the copy sheet passing thereunder.

Referring now to FIGS. 2 and 3, the detacking corona discharge device 23 is continuously supplied with high voltage alternating current from a suitable source such as transformer 30. The discharge device is alternately biased with a first DC voltage from a suitable source such as battery 32 and a second DC voltage from a suitable source such as battery 34. A suitable voltage dropping resistor 36 may be employed in each DC circuit to provide the desired voltage level at the discharge device 23. Also, an AC bypass capacitor 38 may be employed in each DC circuit to shunt the AC component to ground.

A normally closed switch 40 for connecting the first DC source 32 to the discharge device 23 and a normally open switch 42 for connecting the second DC source 34 to the discharge device are adapted to be alternately opened and closed by a suitable timing device in relation to paper position relative to the discharge device 23 for reasons to be hereinafter explained.

By reference to FIG. 3, which is a plot of direct current in microamps having the position of the paper 43 beneath the detacking corona discharge device superimposed above the plot for a set of machine operating conditions wherein it is desirable to increase the positive charge on the body of the copy paper for reasons to be hereinafter explained, it can be seen that by timed operation of switches 40 and 42, a high negative charge may be provided on the lead edge 43' of the copy paper for improved stripping and a low positive or negative charge may be provided on the remaining portion or body of the paper for improved copy quality.

For purposes of illustration only, it is to be assumed that the charging device 13 imparts a positive charge on the xerographic surface and the toner has a negative charge thereon.

Upon exposure, the image areas will retain a high positive charge while the background areas will be discharged to a low, residual positive charge. At the development station, the toner particles will be attracted to the positively charged image areas. At the transfer station, the copy sheet will be provided with a high positive charge to attract the negatively charged toner from the positively charged xerographic surface.

The high positive charge on the paper and the minimal positive charge in the background areas of the xerographic surface provide an attractive force between the paper and the surface of the same magnitude as the attractive force between two surfaces of opposite polarity having the same potential difference.

As stated heretofore, an excessive detacking charge on the sheet will result in re-transfer of toner to the xerographic surface with resultant copy quality deterioration. However, since the edge of the copy sheet ordinarily encompasses the top or edge margins surrounding the informational areas to be copied, a large detacking charge may be employed thereon without serious copy quality deterioration.

If the reproduction machine is designed such that the xerographic surface is curved at the stripping station, the beam strength of the sheet will cause the lead edge thereof to lift from the xerographic surface before it is charged to a level which would cause poor copy quality. Since the lead edge is thus spaced from the surface, further charging thereof will not effect copy quality since the toner thereon is not in contact with the xerographic surface and cannot be retransferred thereto.

Again, assuming that the xerographic surface is initially provided with a positive charge, the transfer roller will be biased to provide a positive charge on the copy paper to attract the negatively charged toner from the xerographic surface to the copy paper. In order to separate the copy paper from the xerographic surface, the lead edge thereof must be negatively charged. Therefore, the first DC bias voltage would be negative to reduce the positive charge on the copy paper. However, the second DC voltage may be positive or negative depending on the magnitude of charge on the body of the copy paper after it has passed through the transfer station. For optimum copy quality, a positive charge is desired on the body of the copy paper at the stripping station. However, if the positive charge on the paper is too high, contact between the paper and grounded elements of the xerographic machine such as paper transports, fuser, etc., may cause an electrical discharge from the copy paper to the grounded elements. This electrical discharge may disturb the loosely adherent toner pattern on the copy paper and result in poor copy quality. Therefore, if the copy paper leaving the transfer station has a high positive charge thereon, the body of the copy paper would be provided with a slight negative charge by the DC biased AC corona discharge device 23 to provide a resultant positive charge on the copy paper insufficient for discharge to the paper transports or other grounded elements of the machine but great enough to hold the toner on the paper.

If the body of the copy paper leaving the transfer station has a low positive charge thereon, the corona discharge device 23 would be biased by a positive DC source to provide sufficient positive charge on the paper for good copy quality but sufficiently low to prevent subsequent discharge therefrom.

Thus, in the preferred embodiment described, the lead edge of the copy paper would be negatively charged by the corona discharge device 23 by supplying a high negative DC bias voltage from battery 32. The body of the copy paper would be treated by supplying the corona discharge device 23 with a small positive or negative DC bias voltage depending upon the efficiency and a charge level of the transfer device to provide a net positive charge on the body of the copy paper.

From the foregoing, it can be seen that by providing a momentary negative DC bias on the AC detack corona discharge device 23 for lifting the lead edge of the paper and a second DC bias on the discharge device as the remainder of the copy sheet passes thereunder, positive stripping of the copy sheet may be obtained while maintaining the desired copy quality level.

While the invention has been described with reference to the structure disclosed, it is not confined to the details set forth but is intended to cover such modifications or changes as may come within the scope of the following claims.

What is claimed is:

1. A method to provide improved stripping of a transfer member from a photoconductive surface after transfer of a developed latent electrostatic image to the transfer member via transfer effecting means comprising the steps of:

charging the lead edge of the transfer member with an AC corona emission means having a high DC bias of opposite polarity from that of the transfer effecting means, and charging the body of the transfer member with said AC corona emission means having a DC bias which is different from the high D.C. bias but of sufficient magnitude and polarity to prevent retransfer of the developed image to the photoconductive surface and to minimize the charge on the transfer member to prevent electron discharge from the transfer member to machine elements in contact therewith after stripping the member from the photoconductive surface.

2. A method to provide improved stripping of a transfer member from a photoconductive surface after transfer of a developed electrostatic image to the transfer member via transfer effecting means comprising the steps of:

charging the lead edge of the transfer member with an AC corona emission means having a first DC bias of opposite polarity from that of the transfer effecting means, and charging the body of the transfer member with said AC corona emission means having a second DC bias of opposite polarity from that of the transfer effecting means, but which is of a different magnitude from said first DC bias.

3. A method to provide improved stripping of a transfer member from a photoconductive surface after transfer of a developed electrostatic image to the transfer member via transfer effecting means comprising the steps of:

charging the lead edge of the transfer member with an AC corona emission means having a first DC bias of opposite polarity from that of the transfer effecting means, and charging the body of the transfer member with said AC corona emission means having a second DC bias of the same polarity as that of the transfer effecting means.

4. A method to provide improved stripping of a transfer member from a photoconductive surface after transfer of a developed latent electrostatic image to the transfer member comprising the steps of:

a. charging the lead edge of the transfer member to provide a charge of a first magnitude on the edge, and then b. charging the image bearing portion of the transfer member without altering the charge on the lead edge to provide a charge of a second magnitude on the portion which is different from said first magnitude.

5. A method to provide improved stripping of a transfer member from a photoconductive surface after transfer of a developed latent electrostatic image to the transfer member comprising the steps of:

a. charging the lead edge of the transfer member to provide a first charge on the edge, and then b. charging the image bearing portion of the transfer member without altering the charge on the lead edge to provide a second charge on the portion which is different from the first charge.

6. A method to provide improved stripping of a transfer member from a photoconductive surface after transfer of a developed latent electrostatic image to the transfer member via transfer effecting means comprising the steps of:

charging the lead edge of the transfer member with a first DC biased AC corona emission, the DC bias being of opposite polarity from that of the transfer effecting means, and charging the image bearing portion of the transfer member without altering the charge on the lead edge with a second DC biased AC corona emission which is different from the first emission, but which is of a magnitude and polarity to prevent retransfer of the developed image to the photoconductive surface and to minimize the charge on the transfer member to prevent electron discharge from the transfer member to machine elements after stripping the member from the photoconductive surface.

7. In an electrostatic reproduction machine having a photoconductive surface and means for forming a powder image thereon in conformity with the image on a document to be reproduced and thereafter transferring the powder image via transfer effecting means to the surface of suitable support material electrostatically tacked to the photoconductive surface, means for removing the support material from the photoconductive surface comprising:

a corona discharge device continuously supplied with high voltage alternating current for treating said support material after transfer of the powder image thereto;

a first source of DC voltage for biasing said corona discharge device to provide a first charge from the corona discharge device to the lead edge of the support material which is of opposite polarity from that of the transfer effecting means;

a second source of DC voltage for biasing said corona discharge device to provide a second charge from the corona discharge device to the body of the transfer member, and switch means adapted to connect said first source of DC voltage to said corona discharge device for treating the lead edge of the support material and for connecting said second source of DC voltage to said corona discharge device for treating the body of the support material.

8. In an electrostatic reproduction machine having a photoconductive surface adapted to be charged, exposed, and to carry an electrostatic latent image thereon, and developing means positioned at a development zone to develop the electrostatic image on said surface, the developed image being adapted for transfer via transfer effecting means to a suitable receiving member electrostatically tacked to said surface for transfer of the developed image thereto, the combination comprising:

a corona discharge device continuously supplied with high voltage alternating current to product ion emissions therefrom;

a first source of DC voltage for appropriately biasing said corona discharge device to provide a first charge on the leading edge of the receiving member which reduces the electrostatic force holding the lead edge of the receiving member on said surface, and a second source of DC voltage for biasing said discharge device to provide a second charge on the body of the receiving member which is different from said first charge but which prevents retransfer of the transferred developed image from the receiving member to the photoconductive surface.

9. In an electrostatic reproduction machine having a moving photoconductive surface adapted to be charged, exposed, and to carry an electrostatic latent image thereon, and developing means positioned at a development zone to develop the moving electrostatic image on said surface, the developed image being adapted for transfer via transfer effecting means to a suitable receiving member electrostatically tacked to said surface for transfer of the developed image thereto, the transfer member having an inherent beam strength which tends to lift the transfer member off of a curved portion of the photoconductive surface, the combination comprising:

a first source of DC voltage of opposite polarity from that of the transfer effecting means for biasing said discharge device to provide a charge on the leading edge of the receiving member so that the electrostatic force holding the lead edge on said surface is less than the lifting force on the lead edge caused by the inherent beam strength of the receiving member; and a second source of DC voltage for biasing said discharge device to provide a charge on the body of the receiving member which is different from the charge provided by the first source on the lead edge but which prevents retransfer of the transferred developed image from the receiving member to the photoconductive surface.

* * * * *